United States Patent [19]

Vigneau et al.

[11] Patent Number: 4,938,708

[45] Date of Patent: Jul. 3, 1990

[54] MOUNTING ARRANGEMENT FOR CARTRIDGE BULB AND IMPROVED TERMINAL THEREFOR

[75] Inventors: Lawrence L. Vigneau, Allen Park; Leonard E. Moriconi, Southfield, both of Mich.

[73] Assignee: United Technologies Automotive, Inc., Dearborn, Mich.

[21] Appl. No.: 370,534

[22] Filed: Jun. 23, 1989

[51] Int. Cl.[5] ..... H01R 33/02

[52] U.S. Cl. ..... 439/239; 439/612; 439/698; 439/733

[58] Field of Search ..... 439/226, 239, 444, 612, 439/698, 816, 830, 835; 248/221.3; 362/217, 249, 257, 306, 733; 313/315, 318, 331

[56] References Cited

U.S. PATENT DOCUMENTS

| | | | |
|---|---|---|---|
| 3,327,110 | 6/1967 | Baldwin | 362/296 |
| 3,633,149 | 1/1972 | Maltais | 439/698 X |
| 4,061,940 | 12/1977 | Fitzgerald et al. | 439/226 X |
| 4,262,228 | 4/1981 | Cruse | 313/318 X |
| 4,288,846 | 9/1981 | Fletcher et al. | 362/217 |
| 4,329,736 | 5/1982 | Nelle et al. | 362/23 |
| 4,360,861 | 11/1982 | Fitzgerald | 362/306 X |
| 4,429,945 | 2/1984 | Nestor | 439/239 X |
| 4,437,145 | 2/1984 | Roller et al. | 362/306 |
| 4,570,210 | 2/1986 | Kosmatka | 362/396 |
| 4,631,651 | 12/1986 | Bergin et al. | 362/267 |
| 4,699,445 | 10/1987 | Porta et al. | 439/830 X |
| 4,740,876 | 4/1988 | Roller | 362/306 X |

*Primary Examiner*—Neil Abrams
*Assistant Examiner*—Kheim Nguyen

[57] ABSTRACT

A pair of terminals are each provided with snap dentents for engaging the contact pins extending from the opposite ends of a baseless cartridge bulb. The terminals are mounted to a support and are spaced a distance D which is substantially exactly the same as the spacing between the contact pins at their points of intended engagement with the terminals. This minimizes the loading on the contact pins relative to their seals with the body of the cartridge bulb, and also provides the support for the bulb. The terminals are of a configuration which facilitates relative entry and removal of the bulb's contact pins, yet also releasably retains those pins in good conducting relation therewith.

8 Claims, 2 Drawing Sheets

MOUNTING ARRANGEMENT FOR CARTRIDGE BULB AND IMPROVED TERMINAL THEREFOR

TECHNICAL FIELD

The invention relates to a mounting arrangement for a cartridge-type bulb and to an improved terminal for use in such mounting arrangement, and more particularly to a mounting arrangement, including one or more terminals, for a baseless cartridge bulb.

BACKGROUND ART

Various types of lamps, or bulbs, have existed for use in automotive vehicles and the like. For many years those bulbs were of the traditional construction wherein base portions, such as screw or bayonet bases, were provided forming the support base for the filament wires and supports therefor. More recently, baseless cartridge bulbs were developed because of the relatively greater expense to manufacture base portions of the more traditional types of bulbs. The baseless cartridge bulbs have afforded various advantages, including a reduction in the manufacturing costs, increased resistance to vibration, and the opportunity to use reduced voltage levels to supply the filament.

In providing a mounting arrangement and electrical connection for baseless cartridge bulbs, it has been known to provide a supporting structure for the bulb and separate electrical connections to the bulb leads, as depicted in U.S. Pat. No. 4,437,145 to Roller et al. In another arrangement for supporting and electrically connecting a baseless cartridge bulb, the electrical connections with the filament leads may comprise at least part of the structure for supporting the bulb, as disclosed in U.S. Pat. No. 4,360,861 to Fitzgerald. In the former arrangement, separate provision must be made for mounting the bulb and for providing the electrical connections. In the latter arrangement, the electrical connections with the filaments leads, because of their additional role as a support for the bulb, typically place the filament leads either in tension or compression. This latter characteristic may be viewed as undesirable since it may contribute to a deterioration of the glass-to-metal seal between the bulb envelope and the filament leads.

SUMMARY OF THE INVENTION

Accordingly, it is a principal object of the invention to provide an improved lamp mounting arrangement for a baseless cartridge bulb. Included within this object is the provision of a mounting arrangement, including electrical terminals for connection with the cartridge bulb in a manner which minimizes the tension or compression to which the filament leads are subjected.

It is a further object of the present invention to provide an improved terminal for receiving and retaining a rod-like contact pin, as for a cartridge bulb, in detented electrical engagement therewith. Included within this object is the provision of such a terminal which is relatively easy and inexpensive to manufacture, yet which effectively retains the contact pin in good conductive relation therewith.

According to the invention, there is provided an improved mounting arrangement for a baseless cartridge bulb. The cartridge bulb includes a body, and at least two contact pins, a respective one of the contact pins being at each of the opposite ends of the body. Each of the contact pins is sealed in the body and has a first portion extending outwardly therefrom and a second portion extending transversely of the first portion. The first portions of the two contact pins extend in respectively opposite directions from each other and the second portions of those two contact pins are spaced from one another by a predetermined distance D. The improved mounting arrangement includes some type of support structure and two terminals mounted to that support structure. Each of the terminals includes a mounting portion and a contact arm portion. Each contact arm portion includes snap detent means for releasably engaging the second portion of a respective contact pin of the cartridge bulb in electrically conducting relation therewith when the bulb is in an operating position. Each terminal is fixedly mounted at its mounting portion to the support means and is configured and positioned relative to the other terminals such that the snap detent means of the contact arm portions are spaced from one another by substantially exactly the predetermined distance D between the second portions of the contact pins of the cartridge bulb. Such mounting and spacing of the terminals minimizes loading the contact pins relative to their respective seals with the body when the cartridge bulb is in an operating position with both of the contact pins in the releasable engagement with the snap detent means of the two terminals.

In an embodiment, the support to which the terminals are mounted is relatively rigid and the terminals are each comprised of relatively rigid strips of conductive metal having their mounting portions rigidly joined to the support means and their contact arm portions extending free thereof The snap detent means of a respective terminal is formed by the contact arm portion having a distal end which is trifurcated to form first, second and third fingers, the first and third fingers being at opposite sides of the second finger. The first and third fingers each are contoured to provide respective seating notches sized and positioned to receive the second portion of a respective contact pin extending transversely of the respective finger and the second finger is configured relative to the first and third fingers to afford relative insertion and removal of the contact pin second portion in the direction longitudinally of the fingers and intermediate the first and third fingers on one side and the second finger on the other side. The first, second and third fingers are further contoured to resiliently bias the contact pin second portion into engagement with the seating notches in the first and third fingers when the bulb is in the operating position. These terminals provide the mounting support, and typically the sole mounting support, for the cartridge bulb when it is in the operating position.

The contact pins of the cartridge bulb in one embodiment are generally U-shaped, having both the first and a third portion extending outwardly from respective seals in the bulb in spaced relation and the second portion extending between and connecting the first and third portions The contact arm portion of each of the terminals is sufficiently narrow that the first and third fingers of the terminal are received between the first and third portions of the respective U-shaped terminal pins.

According to one embodiment of the terminals, the first and third fingers of each contact arm portion are coplanar and, except for the seating notches, substantially straight. The second finger between the first and third fingers is curved such that its free end is spaced from the plane of the first and third fingers in a direction relatively away from the seating notches to facilitate the insertion of the contact pin second portion. In the region proximate the seating notches in the first and third fingers, the second finger is normally displaced from the plane of the first and third fingers relatively toward the seating notches to resiliently urge and retain the contact pin second portion in seated engagement with the seating notches.

BEST MODE(S) FOR CARRYING OUT THE INVENTION

Figure 1:
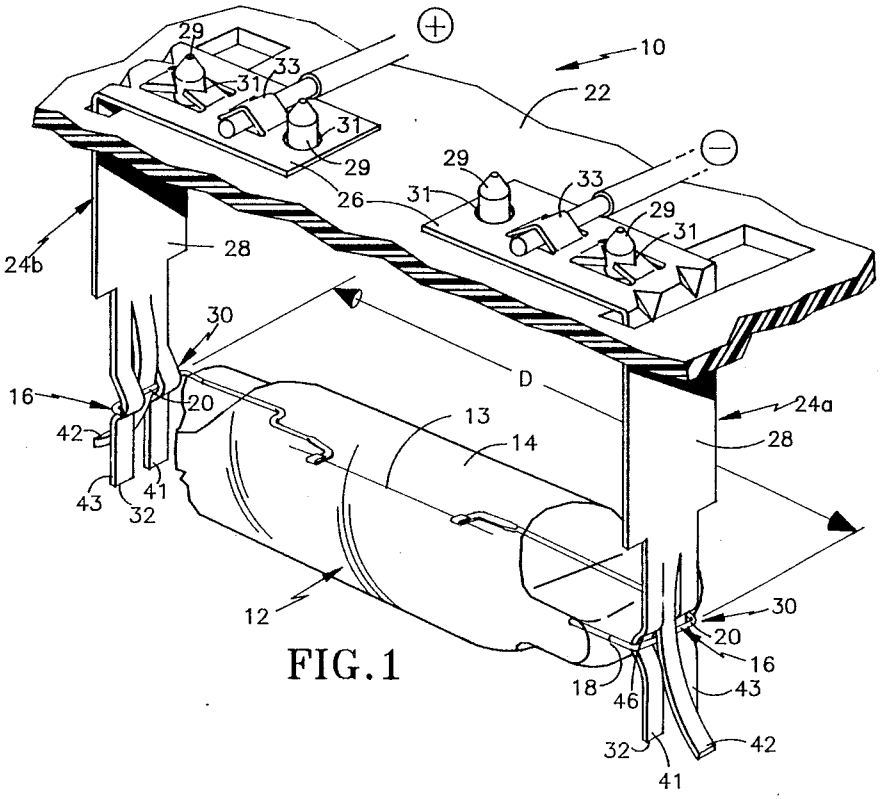
FIG. 1 is a perspective view of a mounting arrangement for a baseless cartridge bulb, partly broken away, in accordance with the invention.

Referring to the Figures, there is shown in FIG. 1 a mounting arrangement 10 for a baseless cartridge lamp, or bulb, 12. The cartridge bulb 12 is incandescent, including a filament 13, and is of the type manufactured by Sylvania and identified as T-3, rigid loop. The bulb 12 includes a glass envelope, or body, 14 which contains the filament 13 that is in turn supported by and electrically connected to a pair of conductive contact pins 16 which are mounted in and extend through opposite ends of the bulb body 14. Each of the contact pins 16 is hermetically sealed in the glass body 14 such that it provides good structural support for the filament 13 therewithin and further preserves the isolation between the interior of the bulb 12 and the surrounding environment external thereto. Each contact pin 16 extends outward from the bulb body 14 at the respective opposite end thereof for connection to an electrical potential of suitable polarity, typically via an electrical terminal connected thereto.

Each contact pin 16 is an electrically conductive metal alloy, typically circular in cross section and having a diameter of about 0.5 mm. Each contact pin 16 additionally includes a first portion 18 which extends longitudinally outward from the bulb body 14 and a second portion 20 which extends transversely of the first portion 18. Thus, the second portions of the two contact pins 16 at the respective opposite ends of the bulb body 14 are themselves substantially parallel to and spaced from one another by a predetermined distance, D. These second portions 20 of the contact pins 16 serve as the region for electrical connection with the terminals to be hereinafter described. Moreover, in the illustrated embodiment of cartridge bulb 12, each of the contact pins 16 includes a respective third portion sealed in the end of the bulb body 14 and extending longitudinally outward to connect with the pin second portion such that the contact has a U-shape externally of the bulb body 14.

Referring further to the bulb mounting arrangement 10 of FIG. 1, a pair of electrically conductive metal terminals 24a and 24b are mounted to and supported by a support member 22. The support member 22 is preferably a rigid material, and may form the base of a cavity in which the bulb 12 is to be housed. In the illustrated embodiment, support member 22 is of molded plastic, having sufficient thickness to rigidly support terminals 24a and 24b.

Each of the terminals 24a and 24b includes a mounting portion, generally designated 26, and a contact arm portion, generally designated 28. In the illustrated embodiment in which the support member 22 is a planar surface to which the terminals 24a, 24b are mounted, the contact arm portions 28 extend at substantially right angles to the mounting portions 26 such that, when mounted, the contact arm portions 28 of terminals 24a and 24b extend substantially parallel one another. Importantly to the invention, the terminals 24a and 24b are mounted and positioned on support member 22 such that the spacing between relevant portions of the two terminals is a distance D, substantially the same as that between the terminal pin second portions 20 of an associated bulb 12.

Various arrangements may be used to substantially rigidly mount the terminals 24a, 24b to the support member 22 in a manner which retains the spacing D substantially constant. In a preferred arrangement, the plastic support member 22 is provided with mounting studs 29 which extend through openings 31 in the mounting portion of the terminal. Each terminal 24a, 24b includes at least one opening 31 for establishing the positioning of the respective terminal in the direction of dimension D. Moreover, that opening 31 preferably is defined by a geometry which serves to grip the mounting stud 29 and retain the terminal in position thereon. This may be accomplished by shaping the metal around the opening 31 such that it provides a one-way friction lock with the mounting stud 29. A second mounting opening 31 may also be provided in the mounting portion 26 of a terminal 24a or 24b for engagement with a second mounting stud 29 to further ensure the mounted stability of the terminal. An arch or hasp 33, formed by deforming part of the terminal 24a, 24b, is used for electrical connection, as by soldering, with an electrical lead which may in turn be connected to an electrical potential of suitable polarity.

Figure 2:
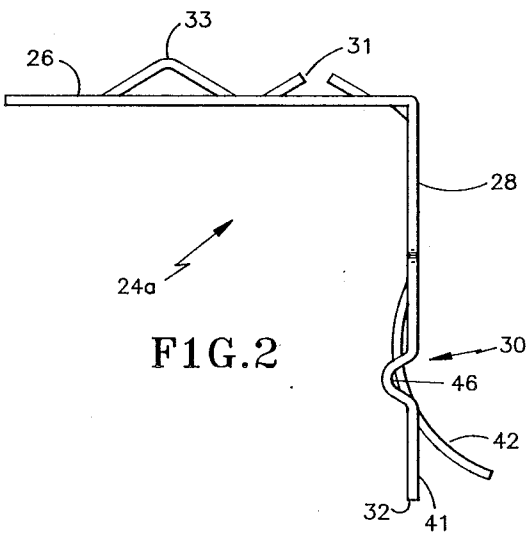
FIG. 2 is a side elevation view of a terminal in accordance with the invention and for use in the mounting arrangement of FIG. 1.
Figure 3:
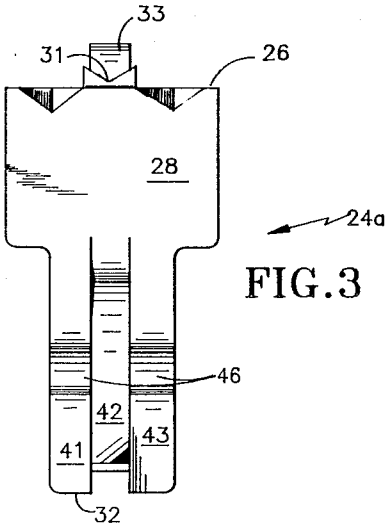
FIG. 3 is a right side view of the terminal of FIG. 2.
Figure 4:
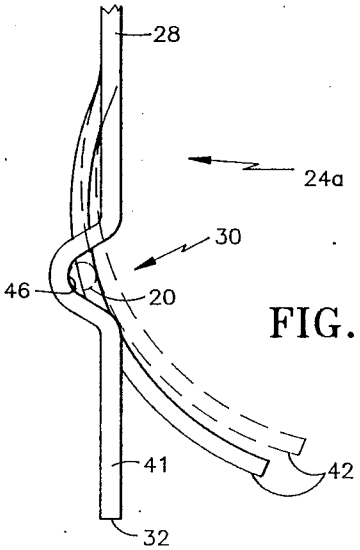
FIG. 4 is an enlarged view of the contact arm portion of the terminal of FIG. 2, depicted both relaxed and, in broken line, in flexed engagement with the terminal pin of a bulb.

Referring additionally to FIGS. 2, 3 and 4, contact arm portion 28 of each of terminal 24a, 24b further includes a snap detenting arrangement, generally designated 30, for releasably holding the second portion 20 of a respective contact pin 16 of the cartridge bulb 12 in electrically conducting relation therewith when the bulb is in an operating position as depicted in FIG. 1. Specifically, it is the spacing is the detent arrangement or mechanism 30 which determines the spacing D between a pair of terminals 24a, 24b.

To provide the snap detent arrangement 30 in each of the terminals 24a, 24b, the distal end 32 of the respective contact arm portion 28 is trifurcated to form first, second and third fingers 41, 42 and 43 respectively extending longitudinally of the contact arm portion. The first and third fingers 41 and 43 are each contoured as by a deforming press, to provide respective seating notches 46 which are sized and positioned to receive the contact pin second portion 20 as it extends transversely of the respective fingers. The second finger 42 is positioned between the first and third fingers 41 and 43 and is configured relative to those fingers to afford and facilitate relative insertion and removal of the contact pin second portion 20 between the first and third fingers 41 and 43 to one side and the second finger 42 to the other side in a direction longitudinally of the fingers. Moreover, the second finger 42 is structured relative to the first and third fingers 41 and 43 such that it biases and maintains an inserted contact pin second portion 20 in firm, detented electrically conductive relationship with the terminal in the seating notches 46.

Referring to FIGS. 2 and 4, the first and third fingers 41 and 43 are shown as being substantially coplanar, except for the respective seating notches 46. On the other hand, the second finger 42 is deformed to a curved or arcuate shape which affords both the desired detenting bias and, at its distal end, a displacement from fingers 41 and 43 which facilitates the insertion of the contact pin second portion 20 longitudinally upward between the fingers to its seated position. The seating notches 46 may be positioned approximately midway of the length of the fingers 41 and 43 and the second finger 42 is then deformed inwardly relative to the seating notches 46 such that, in the unflexed state depicted in solid line in FIG. 4 there is not sufficient clearance between that finger and the seating notch to permit the contact pin second portion 20 to freely slip in and out. Further, the lower or distal end of that second finger 42 is curved forward or outward relative to the seating notches 46 such that it is displaced forwardly or outwardly of the distal ends of the first and second fingers 41 and 43 by an amount sufficient to readily admit the contact pin second portion 20 therebetween for upward insertion into the seated position. The broken line illustration of second finger 42 and contact pin second portion 20 in FIG. 4 depicts that contact pin in its seated position, with the second finger 42 flexed.

Though a particular geometry of fingers 41, 42 and 43 has been described, it will be understood that other different but related geometries might be used to obtain the same result. For instance, a seating notch might also have been formed in the middle finger 42, and that finger might have had a shape and further deformation which differs from the simple arch in the embodiment shown. Still further, the only seating notch might have been provided in the middle finger 42.

The above-described snap detenting mechanism 30 of terminals **24*a* and 24*b* is relatively easy and inexpensive to manufacture, requiring only simple metal stamping and forming operations. Moreover, the detenting mechanism 30 serves to very firmly retain the contact pin 16 of cartridge bulb 12 in good electrical conducting engagement with the terminal. Still further, when a pair of terminals 24*a*, 24*b* are mounted to support member 22 and so spaced as to provide the requisite spacing D between the seating notches 46, the terminals 24*a*, 24*b* then serve to provide the sole support for and electrical contact with, the cartridge bulb 12. Further, the engagement of the terminals 24*a*, 24*b* with the contact pins 16 places very little or no tensile or compressive loading on the contact pin first portion 18, which might otherwise adversely affect the glass to metal seal between the contact pin and the cartridge bulb. To mount the cartridge bulb 12 in the operating position depicted in FIG. 1, it is only necessary to move the bulb in a relatively upward direction such that the contact pin second portions 20 at the respective opposite ends thereof move upwardly between contact fingers 41 and 43 and contact finger 42 into the detented position in seating notches 46**.

Figure 5:
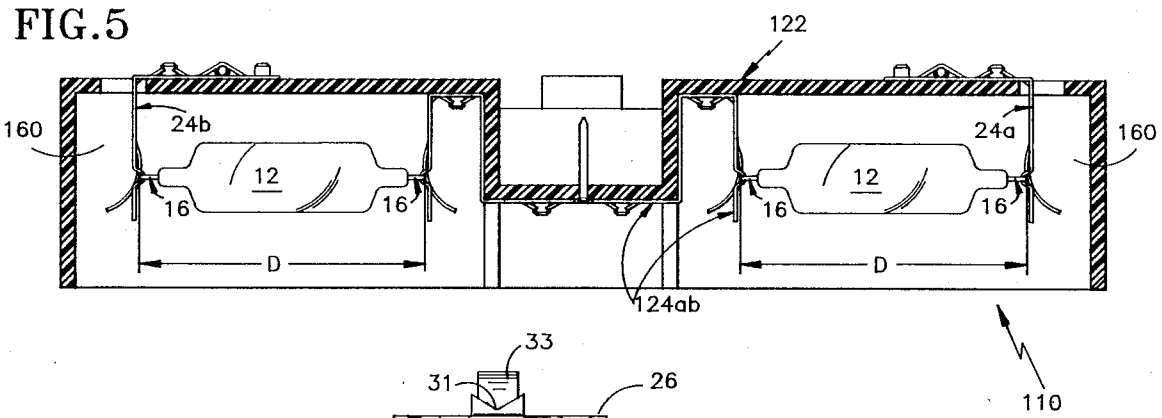
FIG. 5 is a simplified sectional view of a mounting arrangement for multiple baseless cartridge bulbs in accordance with another embodiment.

Referring to FIG. 5, there is a depicted a mounting arrangement 110 for a plurality of baseless cartridge bulbs 12, in this instance two. A support or housing structure 122 is formed of molded plastic and defines a pair of side-by-side housing cavities 160 for respectively receiving the pair of bulbs 12. As in the embodiment depicted in FIG. 1, an appropriate terminal **24*a* or 24*b* is mounted to the support structure 122 in the manner previously described. However it will be noted that for each such bulb 12, only one such terminal 24*a* or 24*b* is provided, that being for the end of the bulb which is relatively outward from the middle or center section of the common housing 122. However, because the contact pins 16 at the relative inner ends of the respective bulbs 12 are relatively close to one another and may be of the same electrical polarity so long as the outboard terminals are of the opposite polarity, a modified terminal 124*ab* may be provided to support and electrically connect the inner terminal pins 16 for both bulbs 12. The common terminal 124*ab* spans the midsection of the support member 122 and is mounted thereto in a manner which may be similar but not identical to that for terminals 24*a* and 24*b*. On the other hand, the contact arm portions and associated snap detent mechanisms for the common terminal 124*ab* are the same as that for terminals 24*a* and 24*b*, which in turn are the same as for those terminals in the embodiment depicted in FIG. 1. By providing a common terminal 124*ab* for the inner ends for the two bulbs 12, the need to provide a separate electrical lead to a further terminal is eliminated, as is also the requirement to mount a fourth terminal to the supporting member 122**.

What is claimed is:

1. A mounting arrangement for a baseless cartridge bulb, the cartridge bulb having a body and two contact pins at respectively opposite ends of the body, each of said contact pins being sealed in said body and having a first portion extending outwardly therefrom and a second portion extending transversely of said first portion, said first portions of said two contact pins extending in respectively opposite directions from each other, said second portions of the two said contact pins being spaced from one another a predetermined distance D, the mounting arrangement comprising:

support means;

two terminals, each of said terminals including a mounting portion and a contact arm portion, each said contact arm portion including snap detent means for releasably engaging said second portion of a respective said contact pin of said cartridge bulb in electrically conducting relation therewith when said bulb is in an operating position, said terminals being fixedly mounted at their respective said mounting portions to said support means and being configured and positioned relative to each other such that the snap detent means of said contact arm portions are spaced from one another by substantially exactly said predetermined distance D between said second portions of said contact pins, thereby to minimize loading said contact pins relative to their respective seals with said body when the cartridge bulb is in an operating position with both of said contact pins in said releasable engagement with said snap detent means of said two terminals.

2. The bulb mounting arrangement of claim 1 wherein said two terminals provide the mounting support for said cartridge bulb when said cartridge bulb is in said operating position.

3. An improved terminal for receiving and retaining a rod-like contact pin, as from a cartridge bulb, in detented electrical engagement therewith, the terminal comprising:

a conductive material having a mounting portion and a contact arm portion;

said mounting portion being adapted to be mounted to a support; and said contact arm portion including snap detent means for releasably engaging said contact pin in electrically conducting relation therewith, said snap detent means comprising said contact arm portion having a distal end, said distal end being trifurcated to form first, second and third fingers, said first and third fingers being at opposite sides of said second finger, said first and third fingers each being contoured to provide respective seating notches sized and positioned to receive said contact pin extending transversely of the respective finger and said second finger being configured relative to said first and third fingers to afford relative insertion and removal of said contact pin in a direction longitudinally of said fingers and intermediate said first and third fingers on one side and said second finger on the other side and to engage and resiliently bias said contact pin into engagement with said seating notches in said first and third fingers.

4. The terminal of claim 3 wherein said first and third fingers of said terminal contact arm portion are coplanar and, except for said seating notches, substantially straight, and wherein said second finger therebetween is curved such that its free end is spaced from the plane of said first and third fingers in a direction relatively away from said seating notches to facilitate the insertion of said contact pin and, in the region proximate said seating notches in said first and third fingers, said second finger is normally displaced from the plane of said first and third fingers relatively toward said seating notches to resiliently urge and retain said contact pin in seated engagement with said seating notches.

5. A mounting arrangement for a baseless cartridge bulb, the cartridge bulb having a body and two contact pins at respectively opposite ends of the body, each of said contact pins being sealed in said body and having a first portion extending outwardly therefrom and a second portion extending transversely of said first portion, said first portions of said two contact pins extending in respectively opposite directions from each other, said second portions of the two said contact pins being spaced from one another a predetermined distance D, the mounting arrangement comprising:

rigid support means;

two terminals, each of said terminals including a mounting portion and a contact arm portion, each said contact arm portion including snap detent means for releasably engaging said second portion of a respective said contact pin of said cartridge bulb in electrically conducting relation therewith when said bulb is in an operating position, said terminals being fixedly mounted at their respective said mounting portions to said support means and being configured and positioned relative to each other such that the snap detent means of said contact arm portions are spaced from one another by substantially exactly said predetermined distance D between said second portions of said contact pins, thereby to minimize loading said contact pins relative to their respective seals with said body when the cartridge bulb is in an operating position with both of said contact pins in said releasable engagement with said snap detent means of said two terminals;

each of said terminals being a relatively snap strip of conductive metal having said mounting portion rigidly, mechanically joined to said support means and having said contact arm portion extending free of said support means; and said snap detent means of the contact arm portion of a respective said terminal comprising said contact arm portion having a distal end, said distal end being trifurcated to form first, second and third fingers, said first and third fingers being at opposite sides of said second finger, said first and third fingers each being contoured to provide respective seating notches sized and positioned to receive said second portion of a respective said contact pin extending transversely of the respective finger and said second finger being configured relative to said first and third fingers to afford relative insertion and removal of a said contact pin second portion in a direction longitudinally of said fingers and intermediate said first and third fingers on one side and said second finger on the other side and to engage and resiliently bias said contact pin second portion into engagement with said seating notches in said first and third fingers when the bulb is in the operating position.

6. A mounting arrangement for a baseless cartridge bulb, the cartridge bulb having a body and two contact pins at respectively opposite ends of the body, each of said contact pins being sealed in said body and having a first portion extending outwardly therefrom and a second portion extending transversely of said first portion, said first portions of said two contact pins extending in respectively opposite directions from each other, said second portions of the two said contact pins being spaced from one another a predetermined distance D, the mounting arrangement comprising:

rigid support means;

two terminals, each of said terminals including a mounting portion and a contact arm portion, each said contact arm portion including snap detent means for releasably engaging said second portion of a respective said contact pin of said cartridge bulb in electrically conducting relation therewith when said bulb is in an operating position, said terminals being fixedly mounted at their respective said mounting portions to said support means and being configured and positioned relative to each other such that the snap detent means of said contact arm portions are spaced from one another by substantially exactly said predetermined distance D between said second portions of said contact pins, thereby to minimize loading said contact pins relative to their respective seals with said body when the cartridge bulb is in an operating position with both of said contact pins in said releasable engagement with said snap detent means of said two terminals;

each of said terminals being a relatively rigid strip of conductive metal having said mounting portion rigidly, mechanically joined to said support means and having said contact arm portion extending free of said support means;

said snap detent means of the contact arm portion of a respective said terminal comprising said contact arm portion having a distal end, said distal end being trifurcated to from first, second and third fingers, said first and third fingers being at opposite sides of said second finger, said first and third fingers each being contoured to provide respective seating notches sized and positioned to receive said second portion of a respective said contact pin extending transversely of the respective finger and said second finger being configured relative to said first and third fingers to afford relative insertion and removal of a said contact pin second portion in a direction longitudinally of said fingers and intermediate said first and third fingers on one side and said second finger on the other side and to engage and resiliently bias said contact pin second portion into engagement with said seating notches in said first and third fingers when the bulb is in the operating position, and said two terminals provide the sole mounting support for said cartridge bulb when said cartridge bulb is in said operating position.

7. The bulb mounting arrangement of claim 6 wherein each of said contact pins is generally U-shaped, having said first portion and a third portion extending outwardly from respective seals in the bulb body in spaced relation to one another, said second portion extending between and connecting said first and third portions, and wherein said contact arm portion of each said terminal is sufficiently narrow that said first and third fingers are received between said first and third portions of respective said U-shaped terminal pins.

8. The bulb mounting arrangement of claim 6 wherein said first and third fingers of each said terminal contact arm portion are coplanar and, except for said seating notches, substantially straight, and wherein said second finger therebetween is curved such that its free end is spaced from the plane of said first and third fingers in a direction relatively away from said seating notches to facilitate said insertion of said contact pin second portion and, in the region proximate said seating notches in said first and third fingers, said second finger is normally displaced from the plane of said first and third fingers relatively toward said seating notches to resiliently urge and retain said contact pin second portion in seated engagement with said seating notches.

* * * * *

UNITED STATES PATENT AND TRADEMARK OFFICE

CERTIFICATE OF CORRECTION

PATENT NO. : 4,938,708

DATED : July 3, 1990

INVENTOR(S) : Lawrence L. Vigneau, Leonard E. Moriconi

It is certified that error appears in the above-identified patent and that said Letters Patent is hereby corrected as shown below:

In the ABSTRACT, lines 1 and 2, "den-tents" should be --detents--.

Column 8, line 7, "snap" should be --rigid--.

Signed and Sealed this

Twenty-fourth Day of September, 1991

*Attest:*

HARRY F. MANBECK, JR.

*Attesting Officer*

*Commissioner of Patents and Trademarks*